US005118091A

United States Patent [19]

Nagamoto et al.

[11] Patent Number: 5,118,091

[45] Date of Patent: Jun. 2, 1992

[54] SHEET TAKE-OUT APPARATUS

[75] Inventors: Masayuki Nagamoto, Ikeda; Shigeo Iki, Itami, both of Japan

[73] Assignee: Laurel Bank Machines Co., Ltd., Tokyo, Japan

[21] Appl. No.: 701,886

[22] Filed: May 17, 1991

[30] Foreign Application Priority Data

May 21, 1990 [JP] Japan ..... 2-130853

[51] Int. Cl.[5] ..... B65H 1/22

[52] U.S. Cl. ..... 271/122; 271/125

[58] Field of Search ..... 271/121, 122, 125

[56] References Cited

U.S. PATENT DOCUMENTS 4,921,238 5/1990 Lane ..... 271/122 X 5,016,866 5/1991 Takahashi ..... 271/122

*Primary Examiner*—Richard A. Schacher

*Attorney, Agent, or Firm*—Fleit, Jacobson, Cohn, Price, Holman & Stern

[57] ABSTRACT

A sheet take-out apparatus which takes out sheets from a sheet stacker by frictional force produced by friction between sheets and a plurality of take-out rollers and separates sheets one by one by frictional force which is produced by friction between the upper face of the sheet and a plurality of friction rollers disposed to be opposite to the take-out rollers and has the opposite direction to that of the first mentioned friction force and the first mentioned friction force, the sheet take-out apparatus including a controller for rotating the take-out rollers with low torque until the rotation of the take-out rollers has become steady. In this apparatus, since the sheets are prevented from being taken out and fed to the gap between the take-out rollers, it is prevented that the leading edges of sheets are damaged or that sheet jamming occurs, whereby it is possible to take out sheets one by one and feed them to a sheet stacking section.

29 Claims, 9 Drawing Sheets

SHEET TAKE-OUT APPARATUS

BACKGROUND OF THE INVENTION

The present invention relates to a sheet take-out and, particularly, to such an apparatus which can reliably take out sheets one by one.

DESCRIPTION OF THE PRIOR ART

In bill receiving machines, bill receiving and dispensing machines or the like, it is required to discriminate the denominations, genuineness of bills or bank notes to be received and/or dispensed and the like and to accurately count the number thereof For these purposes, it is indispensable to reliably feed bills one by one from a bill storing section where a plurality of bills are stored to a discriminating means for discriminating the denominations, genuineness of bills and the like and a counting means for counting of the number of bills.

U.S. Pat. No. 4,871,162 proposes a sheet take-out apparatus for a machine for handling sheets such as bills, which can take out sheets one by one from a sheet storing section where a plurality of sheets are stored. More specifically, this sheet take-out apparatus includes take-out rollers each having a friction portion on a part of circumferential surface thereof and a friction separating means including endless belts each of which are disposed opposite to one of the take-out rollers, can be rotated in the direction opposite to that of the rotation of the take-out rollers and are made of frictional material and back-up rollers each disposed at the opposite side to one of the take-out rollers with respect to one of the endless belts and adapted to support the endless belts, and the apparatus is constituted so that sheets are taken out by frictional force produced by friction between the friction portions of the take-out rollers and the lower face of the sheet and applied to the lower face of the sheet, separated one by one by frictional force produced by friction between the upper face of the sheet and the friction separating means and applied to the upper face of the sheet in the direction opposite to that of the first mentioned frictional force and fed to the discriminating means and the counting means by a sheet transporting mechanism such as transporting belts.

Further, as a discriminating means used for sheet handling machines such as a bill receiving machine, a bill receiving and dispensing machine or the like, there is known a discriminating means for discriminating whether or not unexpected sheets are present, whether or not two or more sheets are being fed while being partly overlapped or the like by detecting the length of sheets by sensors such as photosensors. As shown by U.S. Pat. No. 4,504,916, this kind of the discriminating means discriminates kinds of sheets by detecting the length of sheets based upon time periods calculated on the basis of time of detection signals output from the respective sensors.

Accordingly, in the case where sheets have been fed from a sheet storing section to a sheet transporting mechanism such as transporting belts before the rotation of a motor for driving the sheet transporting mechanism has become steady, since the feeding speed of sheets being fed by the sheet transporting mechanism has not become constant, there is some risk of the discriminating means erroneously detecting the length of the sheets.

For solving this problem, the sheet take-out apparatus have been conventionally constituted in the following manner. A pulley rotated by a motor for driving the sheet transporting mechanism is rotatably mounted at one end of a roller shaft for supporting the take-out rollers and there are provided a electromagnetic clutch capable of connecting the pulley and the roller shaft so that they are rotated together and, at the other end of the roller shaft, a electromagnetic brake capable of stopping the rotation of the roller shaft. Until the rotation of the motor for driving the sheet transporting mechanism has become steady, the electromagnetic clutch is controlled so that it is not actuated for so as to prevent the rotational force of the motor from being transmitted to the roller shaft and the electromagnetic brake is actuated so as to stop the rotation of the roller shaft, that is, the rotation of the take-out rollers Then, after the rotation of the motor for driving the sheet transporting mechanism has become steady, the operation of the electromagnetic brake is stopped and the electromagnetic clutch is actuated so that the roller shaft and the pulley are connected, thereby to transmit the rotational force to the roller shaft and to rotate the take-out rollers. As described above, the sheet take-out apparatus is normally controlled so that sheets are not taken out by the take-out rollers until the rotation of the motor for driving the sheet transporting mechanism such as transporting belts has become steady.

However, in the sheet take-out apparatus in which the rotation of the take-out rollers is stopped until the rotation of the motor for driving the sheet transporting mechanism such as transporting belts has become steady and in which the take-out rollers starts to be rotated after the rotation of the motor for driving the sheet transporting mechanism such as transporting belts has become steady, the take-out rollers which have been stopped are suddenly rotated at high speed when the electromagnetic clutch is actuated. Therefore, great frictional force instantaneously acts on the lower face of the lowermost sheet of sheets stacked in the sheet storing section, whereby a plurality of sheets are simultaneously taken out from the sheet storing section and are forced to be fed to a narrow gap between the takeout rollers and the friction separating means. As a result, there arises problems that the leading edges of the sheets are damaged, or that sheet jamming occurs and sheets cannot pass through the gap between the take-out rollers and the friction separating means and cannot be fed to the sheet transporting means until the take-out rollers have been rotated several times, or further that according to circumstances, the rotation of the take-out rollers is stopped, whereby sheets cannot be fed at all. Although these problems do not often arise if sheets are set in the sheet storing section in a desired manner, since it cannot be actually expected that sheets are always set in the sheet storing section in a desired manner, it is strongly required to solve these problems.

SUMMARY OF THE INVENTION

It is, therefore, an object of the present invention to provide a sheet take-out apparatus which can reliably take out sheets one by one.

According to the present invention, the above and other objects can be accomplished by a sheet take-out apparatus comprising sheet storing means for storing a plurality of stacked sheets, take-out roller means disposed at one end of the sheet storing means and at a portion where it can abut against an end portion of a lower face of a lowermost sheet of the sheets stacked in the sheet storing means, having a friction portion on at least a part of an outer periphery thereof and adapted for taking out sheets from said sheet storing means by applying frictional force produced by friction between itself and the lower face of the lowermost sheet in accordance with the rotation thereof to the lower face of the lowermost sheet, friction separating means disposed at a portion opposite to said take-out roller means and adapted for separating sheets one by one by applying frictional force, the direction of which is opposite to that of the frictional force applied from the takeout roller means to the lowermost sheet, produced by friction between itself and an upper face of the sheet taken out from the sheet storing means to the upper face of the sheet, take-out roller shafts for supporting said take-out roller means, a pulley rotatably supported by said take-out roller shaft, electromagnetic clutch means adapted to connect said pulley and said take-out roller shaft so that said pulley can rotate together with said take-out roller shaft, a motor adapted to rotate said pulley, start means operated by an operator for starting the rotation of said motor and control means adapted for actuating said electromagnetic clutch means so as to connect said pulley and said take-out roller shaft after the rotation speed of the motor has become constant, said sheet take-out apparatus being constituted so that until the rotation speed of said motor has become constant after said start means was operated and the rotation of said motor started , said control means controls the rotation of said take-out roller shaft so as to rotate said take-out roller shaft with low torque which produces frictional force applied to the lower face of the lowermost sheet lower than that capable of separating sheets one by one in cooperation with that applied from said friction separating means to the upper face of the sheets.

In a first preferred aspect of the present invention, the sheet take-out apparatus further includes preparatory drive means adapted to rotate said take-out roller means and until the rotation speed of said motor has become constant after said start means was operated and the rotation of said motor started, said control means is adapted to actuate said preparatory drive means so as to rotate said take-out roller shaft with low torque which produces frictional force applied to the lower face of the lowermost sheet lower than that capable of separating sheets one by one in cooperation with that applied from friction separating means to the upper face of the sheets.

In a second preferred aspect of the present invention, said preparatory drive means comprises a torque limiter disposed between one end of said take-out roller shaft and said pulley.

In a third preferred aspect of the present invention, said preparatory drive means comprises a preparatory drive pulley supported by said take-out roller shaft, a preparatory drive motor and a one-way clutch disposed between said preparatory drive pulley and said take-out roller shaft and adapted to transmit only the rotational force of the preparatory drive pulley having the same direction as that of sheet transportation to said take-out roller shaft and said control means is adapted to drive the preparatory drive motor until the rotation speed of the motor has become constant after the start means was operated and the rotation of the motor started.

In a fourth preferred aspect of the present invention, the sheet take-out apparatus further includes feed roller means having a friction portion on at least a part of an outer periphery thereof and disposed below the sheet storing means so as to be able to abut the lower face of the lowermost sheet of the sheets stacked in said sheet storing means, a feed roller shaft for supporting said feed roller means and synchronous drive means adapted to synchronously rotate said feed roller shaft with said take-out roller shaft.

In a fifth preferred aspect of the present invention, the sheet take-out apparatus further includes electromagnetic brake means adapted to stop the rotation of the take-out roller shaft and said control means is adapted to stop the operation of said electromagnetic brake means and hold said take-out roller shaft rotatable until the rotation speed of the motor has become constant after the start means was operated and the rotation of the motor started.

In a sixth preferred aspect of the present invention, the sheet take-out apparatus further includes the electromagnetic brake means adapted to stop the rotation of the take-out roller shaft and timer means for counting time elapsed since the start means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated, and stop the operation of said electromagnetic clutch means and actuate said electromagnetic brake means when the timing signal is input from said timer means.

In a seventh preferred aspect of the present invention, the sheet take-out apparatus further includes the electromagnetic brake means adapted to stop the rotation of the take-out roller shaft and rotation position detecting means for detecting the rotation position of the take-out roller shaft and outputting a detection signal to said control means after the take-out roller shaft was rotated until a leading edge of at least one sheet has come into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated, and stop the operation of said electromagnetic clutch means and actuate said electromagnetic brake means when the detection signal is input from said rotation position detecting means.

The above and other objects of the present invention can be also accomplished by a sheet take-out apparatus comprising sheet storing means for storing a plurality of stacked sheets, take-out roller means disposed at one end of the sheet storing means and at a portion where it can abut against an end portion of a lower face of a lowermost sheet of the sheets stacked in the sheet storing means, having a friction portion on at least a part of an outer periphery thereof and adapted for taking out sheets from said sheet storing means by applying frictional force produced by friction between itself and the lower face of the lowermost sheet in accordance with the rotation thereof to the lower face of the lowermost sheet, friction separating means disposed at a portion opposite to said take-out roller means and adapted for separating sheets one by one by applying frictional force, the direction of which is opposite to that of the frictional force applied from the take-out roller means to the lowermost sheet, produced by friction between itself and an upper face of the sheet taken out from the sheet storing means to the upper face of the sheet, take-out roller shafts for supporting said take-out roller means, feed roller means having a friction portion on at least a part of an outer periphery thereof and disposed below the sheet storing means so as to be able to abut against the lower face of the lowermost sheet of the sheets stacked in said sheet storing means, a feed roller shaft for supporting said feed roller means, synchronous drive means adapted to synchronously rotate said feed roller shaft with said take-out roller shaft, a pulley rotatably supported by said feed roller shaft, electromagnetic clutch means adapted to connect said pulley and said feed roller shaft so that said pulley can rotate together with said feed roller shaft, a motor adapted to rotate said pulley, start means operated by an operator for starting the rotation of said motor and control means for actuating said electromagnetic clutch means after the rotation speed of the motor has become constant so as to connect said pulley and said feed roller shaft, said sheet take-out apparatus being constituted so that after said start means was operated and the rotation of said motor started, until the rotation speed of said motor has become constant, said control means controls the rotation of said feed roller shaft so as to rotate said feed roller shaft with low torque which produces frictional force applied to the lower face of the lowermost sheet lower than that capable of separating sheets one by one in cooperation with that applied from said friction separating means to the upper face of the sheets.

In a first preferred aspect of this apparatus, the sheet take-out apparatus further includes preparatory drive means adapted to rotate said feed roller means and until the rotation speed of said motor has become constant after said start means was operated and the rotation of said motor started, said control means is adapted to actuate said preparatory drive means so as to rotate said feed roller shaft with low torque which produces frictional force applied to the lower face of the lowermost sheet lower than that capable of separating sheets one by one in cooperation with that applied from friction separating means to the upper face of the sheets.

In a second preferred aspect of this apparatus, said preparatory drive means comprises a torque limiter disposed between one end of said feed roller shaft and said pulley.

In a third preferred aspect of this apparatus, said preparatory drive means comprises a preparatory drive pulley supported by said feed roller shaft, a preparatory drive motor and a one-way clutch disposed between said preparatory drive pulley and said feed roller shaft and adapted to transmit only the rotational force of the preparatory drive pulley having the same direction as that of sheet transportation to said feed roller shaft and said control means is adapted to drive the preparatory drive motor until the rotation speed of the motor has become constant after the start means was operated and the rotation of the motor started.

In a fourth preferred aspect of this apparatus, the sheet take-out apparatus further includes electromagnetic brake means adapted to stop the rotation of the feed roller shaft and said control means is adapted to stop the operation of said electromagnetic brake means and hold said feed roller shaft rotatable until the rotation speed of the motor has become constant after the start means was operated and the rotation of the motor started.

In a fifth preferred aspect of this apparatus, the sheet take-out apparatus further includes the electromagnetic brake means adapted to stop the rotation of the feed roller shaft and timer means for counting time elapsed since the start means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said feed roller shaft and said pulley and stop the operation of the electromagnetic brake means when the start means is operated, and stop the operation of said electromagnetic clutch means and actuate said electromagnetic brake means when the timing signal is input from said timer means.

In a sixth preferred aspect of this apparatus, the sheet take-out apparatus further includes the electromagnetic brake means adapted to stop the rotation of the feed roller shaft and rotation position detecting means for detecting the rotation position of the feed roller shaft and outputting a detection signal to said control means after the feed roller shaft was rotated until a leading edge of at least one sheet has come into abutment against the takeout roller means and said friction separating means and before the rotation speed has become constant and said control means is adapted to actuate said electromagnetic clutch means so as to connect said feed roller shaft and said pulley and stop the operation of the electromagnetic brake means when the start means is operated, and stop the operation of said electromagnetic clutch means and actuate said electromagnetic brake means when the detection signal is input from said rotation position detecting means.

The above and other objects and features of the present invention will become apparent from the following description made with reference to the accompanying drawings.

DESCRIPTION OF THE PREFERRED EMBODIMENTS

Figure 1:
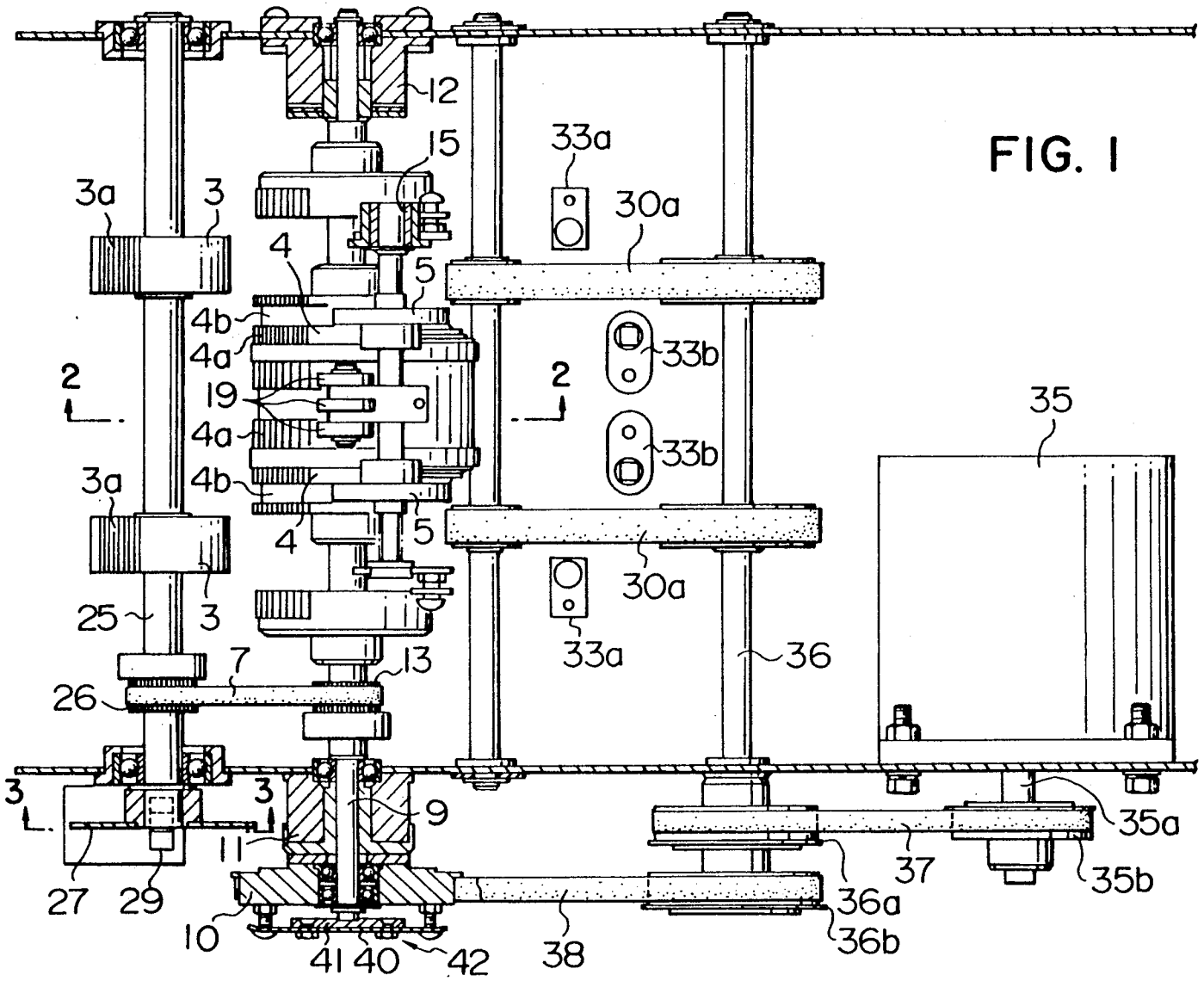
FIG. 1 is a schematic drawing showing a plan view of a sheet take-out apparatus which is an embodiment of the present invention.
Figure 2:
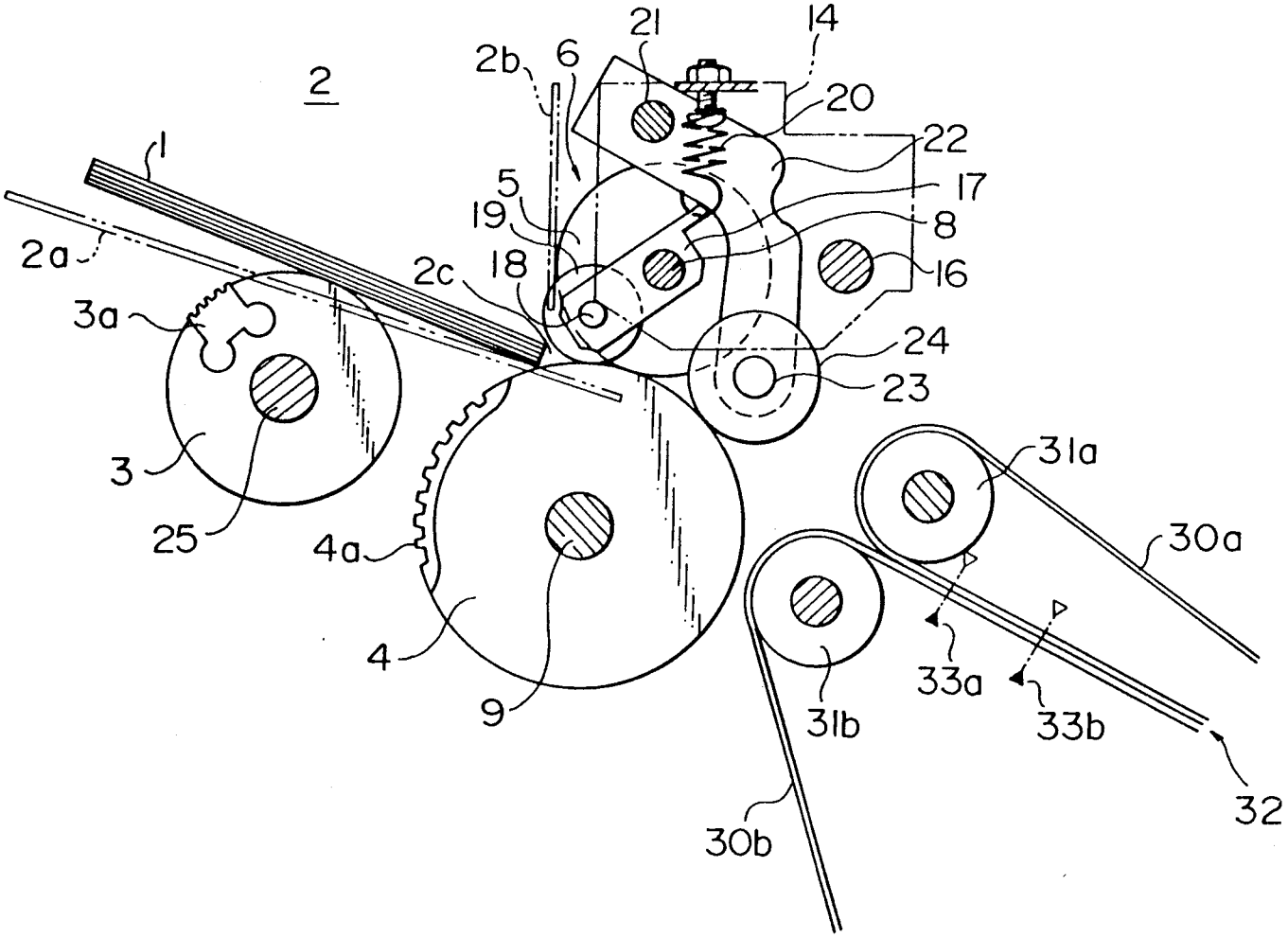
FIG. 2 is a schematic drawing showing a cross sectional view taken on line X—X of FIG. 1.
Figure 3:
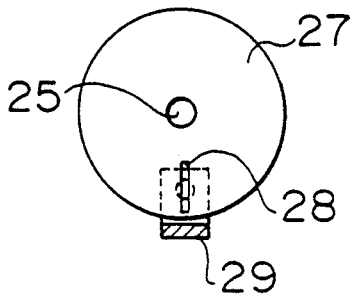
FIG. 3 is a schematic drawing showing a cross sectional view take on line Y—Y of FIG. 1.

FIG. 1 is a schematic drawing showing a plan view of a sheet take-out apparatus which is an embodiment of the present invention and is provided in a sheet handling machine and FIG. 2 is a schematic drawing showing a cross sectional view taken on line X—X of FIG. 1.

Referring to FIGS. 1 and 2, sheets 1 are stacked and stored in a sheet storing means 2 having a bottom plate 2*a* and a front plate 2*b* and a pair of feed rollers 3 are provided so that a part thereof projects from an opening (not shown) of the bottom plate 2*a*, a part of the periphery of each feed roller 3 being formed with a friction portion 3*a*.

Below an opening 2*c* formed between the bottom plate 2*a* and the front plate 2*b*, a pair of take-out rollers 4 are provided at a portion where they can abut against the end portion of the lower face of a lowermost sheet of sheets 1 stacked in the sheet storing means 2, a part of the periphery of each take-out roller 4 being formed with a friction portion 4*a*. On the other hand, a pair of separation rollers 5 are provided at a portion downstream of the opening 2*c* and above and opposite to the pair of take-out rollers 4, whereby friction separating means 6 is formed.

The take-out rollers 4 and the feed rollers 3 are connected by a timing belt 7 so as to be rotated together and the separation rollers 5 are rotatable only clockwise in FIG. 2, that is, in only the opposite direction to the transporting direction of sheets 1 and fixed to a separation roller shaft 8 which is held stationary. Accordingly, when the feed rollers 3 and the take-out rollers 4 are rotated clockwise in FIG. 2, friction force is produced by friction between the respective friction portions 3*a* and 4*a* and the lower face of the lowermost sheet 1 of sheets 1 stacked in the sheet storing means 2 and this frictional force acts on the sheets 1 in the sheet transporting direction, whereby the sheets 1 are taken out from the sheet storing means 2 until the leading edges thereof come into abutment against the separation rollers 5. Since the separation rollers 5 are rotatable only clockwise and fixed to the separation roller shaft 8 held stationary, friction force is produced by friction between the upper face of the sheet 1 taken out and the separation rollers 5 and this frictional force acts on sheets 1 in the direction opposite to that of the frictional force applied from the friction portions 4*a* of the take-out rollers 4 to the lower face of the sheet 1. Therefore, even in the case where two or more sheets 1 are taken out from the sheet storing means 2, the sheets 1 are separated one by one by this frictional force and fed further downwardly.

The take-out rollers 4 are fixed to a take-out roller shaft 9 and, as shown in FIG. 1, a pulley 10 is supported at one end of the take-out roller shaft 9. Further, a electromagnetic clutch 11 capable of connecting the take-out roller shaft 9 and the pulley 10 is provided so as to be adjacent to the pulley 10. At the other end of the take-out roller shaft 9, there is provided a electromagnetic brake 12 capable of stopping the rotation of the take-out roller shaft 9. Further, a gear 13 is fixed to the take-out roller shaft 9, the timing belt 7 being engaged with the gear 13.

On the other hand, the separation roller shaft 8 to which the separation rollers 5 are fixed is supported by a block 14 via a one-way clutch 15 so that separation rollers 5 are rotatable only clockwise in FIG. 2.

Further, the block 14 is fixed to the block shaft 16 and a clearance between the take-out rollers 4 and the separation rollers 5 is adjustable by rotating the block shaft 16.

Moreover, there is provided a first arm 17 which is swingably supported by the separation roller shaft 8 supported by the block 14 and extends toward the front plate 2*b* of the sheet storing means 2 and driven rollers 19 are rotatably supported by a shaft 18 formed at the end of the first arm 17 in the vicinity of front plate 2*b*, the driven rollers 19 being adapted to abut against the periphery of the take-out rollers 4. On the other hand, one end of a tension spring 20 is fixed to the end of the first arm 17 opposite to the front plate 2*b* and the tension spring 20 biases the driven rollers 19 against the periphery of the take-out rollers 4. Further, there is provided a second arm 22 which is rotatably supported by a shaft 21 of the block 14 and extends toward the periphery of the take-out rollers 4 on the downstream side with respect to the sheet transporting direction and driven rollers 24 are rotatably supported by a shaft 23 formed at the end of the second arm 22 in the vicinity of the take-out rollers 4. The second arm 22 is biased by a spring (not shown) so that the driven rollers 24 can abut against the periphery of the take-out rollers 4.

As shown in FIG. 1, the periphery of each take-out roller 4 is formed with a groove 4*b* and a clearance between each take-out roller 4 and one of the separation rollers 5 disposed opposite thereto is adjustable in such a manner that a very small part of the separation roller 5 is positioned in the groove 4*b* of the take-out roller 4. Therefore, when the sheet 1 passes through a portion between the takeout rollers 4 and the separation rollers 5, the sheet 1 is deformed and comes into intimate contact with the friction portions 4*a* of the take-out rollers 4, whereby great frictional force is produced by friction between the lower face of the sheet 1 and the friction portions 4*a* of the take-out rollers 4.

Further, as shown in FIG. 1, feed rollers 3 are fixed to a feed roller shaft 25 to which a gear 26 having the same diameter as that of the gear 13 fixed to the takeout roller shaft 9 is fixed and the timing belt 7 is engaged with the gear 13 and the gear 26. Accordingly, the take-out rollers 4 and the feed rollers 3 are rotated at the same rotating speed.

Moreover, a disc 27 is fixed to one end of the feed roller shaft 25 and is formed with a slit 28. In the vicinity of the disc 27, a rotation position sensor 29 comprising a light emitting element (not shown) and a light receiving element (not shown) is provided.

As shown in FIG. 2, downstream of the take-out rollers 4 and the friction separating member 6, there are provided a pair of transporting belts 30*a*, 30*b* for receiving sheets 1 which have passed through the gap between the take-out rollers 4 and the friction separating member 6 and transporting them downwardly in the sheet handling machine to stack them in a sheet stacking section (not shown), each of the transporting belts 30*a*, 30*b* consisting of an endless belt and being engaged with a pulley 31*a*, 31*b*. In a sheet transporting passage 32 formed by the transporting belts 30*a*, 30*b*, a first photosensor 33*a* and a second photosensor 33*b* are provided at a predetermined interval. By respectively measuring time when sheets 1 passes through the first photosensor 33*a* and the second photosensor 33*b*, not only kinds of sheets 1 and such an abnormal feed that two or more partly overlapped sheets 1 are being transported can be detected but also the number of sheets 1 can be counted.

Further, there is provided a motor 35 for driving the take-out rollers 4, the feed rollers 3 and the transporting belts 30*a*, 30*b* and a drive pulley 35*b* is fixed to the output shaft 35*a* of the motor 35. Moreover, a driven pulley 36*a* and an intermediate pulley 36*b* are fixed to a transporting belt drive shaft 36 for driving the transporting belts 30*a*, 30*b* and the drive pulley 35*b* and the driven pulley 36*a* are connected by a drive belt 37, while the intermediate pulley 36*b* and the pulley 10 rotatably supported by the take-out roller shaft 9 are connected by a transmission belt 38.

A leaf spring 40 is fixed to the side face of the pulley 10 opposite to the take-out rollers 4, the leaf spring 40 consisting of a plate extending substantially parallel with the side face of the pulley 10 and a friction plate 41 is fixed to the side face of the leaf spring 40 on the side of the pulley 10. The central portion of the friction plate 41 are pressed onto the end portion of the takeout roller shaft 9 by the leaf spring 40, whereby a torque limiter 42 is formed by the leaf spring 40 and the friction plate 41. Therefore, even in the state where the electromagnetic clutch 11 is off and the pulley 10 and the take-out roller shaft 9 are not engaged, the rotation of pulley 10 can be transmitted to the take-out roller shaft 9. However, in the state where the pulley 10 and the take-out roller shaft 9 are not engaged by the electromagnetic clutch 11, the magnitude of torque transmittable from the pulley 10 to the take-out roller shaft 9 by the torque limiter 42 is determined so as to apply frictional force from the feed roles 3 and the take-out rollers 4 to the lower face of the sheet 1 in accordance with the rotation of the feed rollers 3 and the take-out rollers 4, the frictional force being lower than the minimum frictional force which acts on the lower face of the sheet 1 and can separate two or more sheets 1 in cooperation with frictional force acting on the upper face of the sheet 1 from separation rollers 5.

Figure 4:
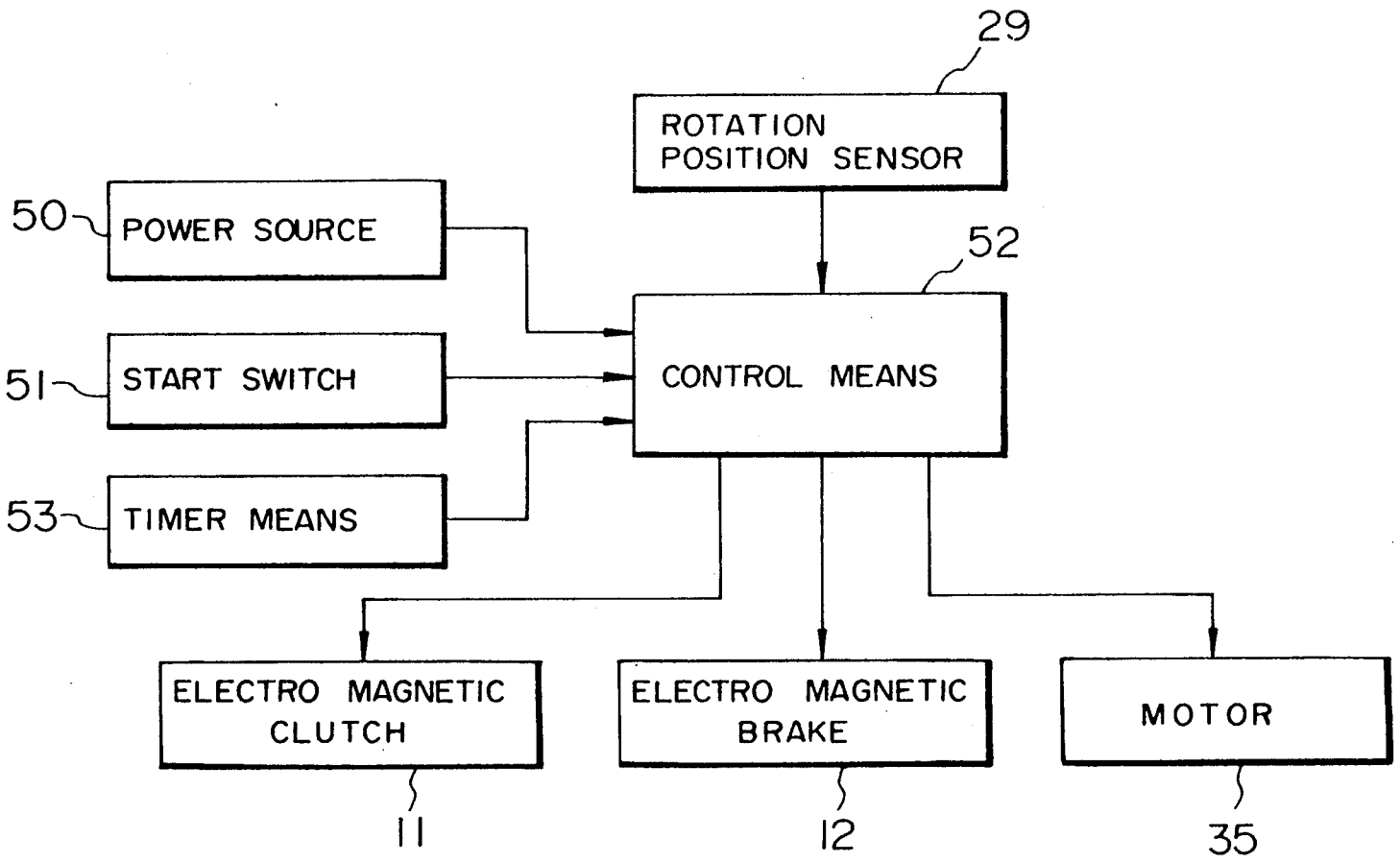
FIG. 4 is a block diagram showing a control system of a sheet take-out apparatus which is shown in FIGS. 1 to 3 and is an embodiment of the present invention FIG. 5(*a*), 5 (*b*) and (*c*) is a time chart showing timings of the rotation of a motor, the operation of an electromagnetic clutch and the operation of an electromagnetic brake.
Figure 6:
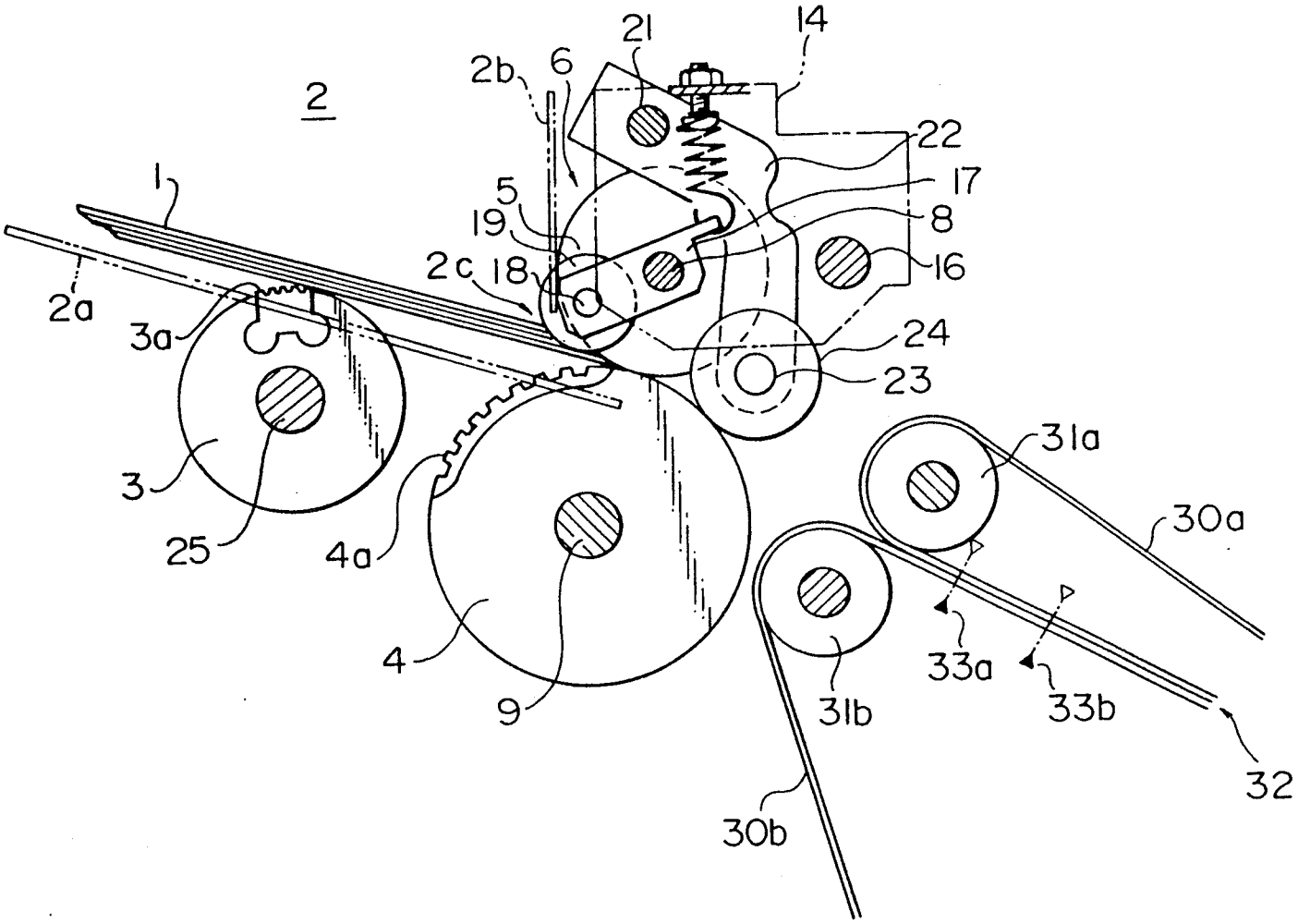
FIG. 6 is a schematic drawing showing a cross sectional view taken on line X—X of FIG. 1 in the state where a sheet is fed to a gap between take-out rollers and friction separating members.

FIG. 4 is a block diagram of a control system of the sheet take-out apparatus which is an embodiment of the present invention.

Referring to FIG. 4, the control system of the sheet take-out apparatus which is an embodiment of the present invention comprises a control means 52 to which an "on" signal or an "off" signal is input from a power source 50 and a start signal or a stop signal is input from a start switch 51 and a timer means 53 for outputting a timing signal when a predetermined time period which ensures that the rotation speed of the motor 35 has become constant has passed since the start signal was input from the start switch 51.

When the "on" signal is input from the power source 50, the control means 52 outputs an actuation signal to the electromagnetic clutch 11 to cause it to connect the pulley 10 and take-out roller shaft 9 and simultaneously outputs a drive signal to the motor 35 to drive it. Afterwards, when an initiating operation completion signal is input from the rotation position sensor 29, the control means 52 outputs a stop signal to the electromagnetic clutch 11, thereby to disconnect the pulley 10 and the take-out roller shaft 9, outputs an actuation signal to the electromagnetic brake 12 to actuate it, thereby to stop the rotation of the take-out roller shaft 9 and outputs a drive stop signal to the motor 35 to stop it. Further, when the start signal is input from the start switch 51 after initiating operation completion signal was input from the rotation position sensor 29, the control means 52 outputs a drive signal to the motor 35 to drive it and outputs a stop signal to the electromagnetic brake 12 to stop the operation of the electromagnetic brake 12, thereby to cause the take-out roller shaft 9 to become rotatable. Moreover, when the timing signal is input from the timer means 53 and the control means 52 judges that the rotation speed of the motor 35 has become constant, it outputs an actuation signal to the electromagnetic clutch 11 to connect the pulley 10 and take-out roller shaft 9, thereby to transmit the rotational force of the motor 35 to the take-out roller shaft 9 via the pulley 10 and rotate the feed rollers 3 and the take-out rollers 4 so that the sheet take-out operation is started.

In the thus constituted sheet take-out apparatus which is an embodiment of the present invention, prior to the sheet take-out operation, an initiating operation is carried out for positioning the friction portions 3*a* of the feed rollers 3 and the friction portions 4*a* of the take-out rollers 4 at their predetermined positions, that is, positions shown in FIG. 2 by turning the power source 50 on in the state where no sheet 1 is set in the sheet storing means 2. More specifically, when the power source 50 is turned on, an actuation signal is output from the control means 52 to the electromagnetic clutch 11 so that the electromagnetic clutch 11 is actuated, whereby the pulley 10 and the takeout roller shaft 9 are connected. In this state, no actuation signal is output from the control means 52 to the electromagnetic brake 12 and, therefore, the electromagnetic brake 12 is off and not actuated. Further, the control means 52 simultaneously outputs a drive signal to the motor 35 to drive it.

The driving force of the motor 35 is transmitted to the transporting belt drive shaft 36 via the driven pulley 35*b* fixed to the output shaft 35*a*, the drive belt 37 and the driven pulley 36*a* so that the transporting belts 30*a*, 30*b* are driven. At the same time, the driving force of the motor 35 is transmitted to the pulley 10 via the intermediate pulley 36*b* fixed to the transporting belt drive shaft 36 and the transmission belt 38, whereby the pulley 10 is rotated. Since the electromagnetic clutch 11 is on and the pulley 10 and the take-out roller shaft 9 are connected, the rotating force of the pulley 10 is transmitted to the take-out roller shaft 9 so that the take-out rollers 4 are rotated and that the rotating force of the take-out roller shaft 9 is transmitted to the feed roller shaft 25 via the timing belt 7 engaged with the gear 13 fixed to the take-out roller shaft 9 and the gear 26 fixed to the feed roller shaft 25, whereby the feed rollers 3 are rotated in synchronism with the take-out rollers 4.

Thus, when the slit 28 is detected by the rotation position sensor 29 and it is detected that the feed roller shaft 25 is positioned at its predetermined position, the detection signal is output from the rotation position sensor 29 to the control means 52 and the control means 52 outputs a stop signal to the electromagnetic clutch 11 to turn it off and outputs an actuation signal to the electromagnetic brake 12, whereby the electromagnetic brake 12 is turned on and actuated. As a result, the rotation of the take-out roller shaft 9 is stopped by the electromagnetic brake 12, whereby the feed rollers 3 and the take-out rollers 4 are stopped at positions shown in FIG. 2 and the initiating operation has been completed. Since there is some possibility of some sheets 1 remaining in the sheet handling machine when the preceding sheet take-out operation was completed, the feed rollers 3 and the take-out rollers 4 are rotated until all of the remaining sheets 1 have been discharged from the sheet handling machine and when it is detected that the feed roller shaft 25 is positioned at a predetermined rotation position, the initiating operation is completed. Therefore, the control means 52 is constituted so that after the rotation position sensor 29 detected the slit 28 predetermined times, when it detects the slit 28, the initiating operation is completed.

Afterwards, sheets 1 are set in the sheet storing means 2 and when the start switch 51 is turned on, the sheet take-out operation is started.

Figure 5:
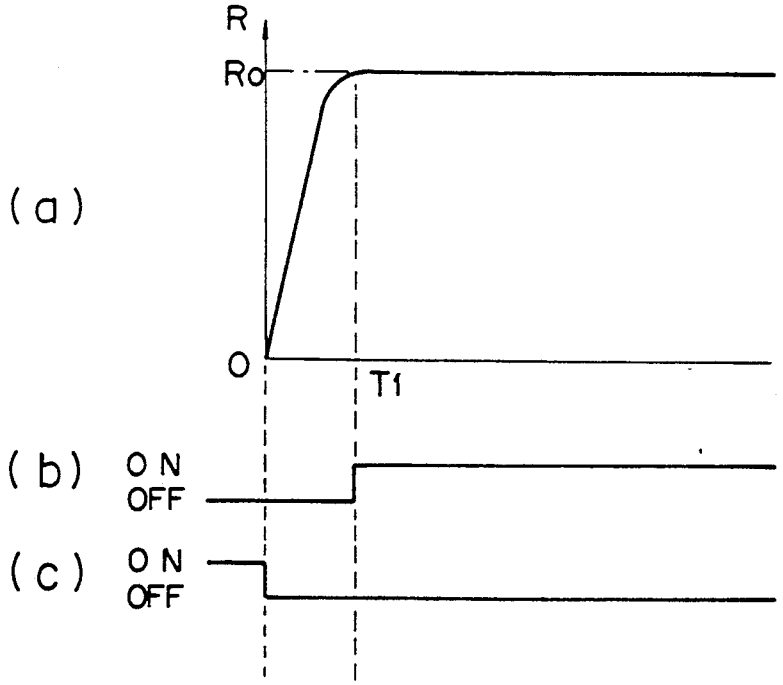

FIG. 5(*a*), (*b*), (*c*) is a time chart showing timings of the rotation of the motor 35, the operation of the electromagnetic clutch 11 and the operation of the electromagnetic brake 12. FIG. 5(*a*) shows the rotation speed R of the motor 35, FIG. 5(*b*) shows "on" and "off" timings of the electromagnetic clutch 11 and FIG. 5(*b*) shows "on" and "off" timings of the electromagnetic brake 12.

As shown in FIG. 5(*a*), (*b*), (*c*), after the initiating operation was completed, when the start switch 51 is turned on and the start signal is input to the control means 52, the control means 52 outputs a drive signal to the motor 35 to drive it and outputs a stop signal to the electromagnetic brake 12 to stop the operation thereof so that the take-out roller shaft 9 becomes rotatable. However, since no actuation signal is output to the electromagnetic clutch 11, the electromagnetic clutch 11 is held off and the pulley 10 and the take-out roller shaft 9 are not connected.

Therefore, similarly to the initiating operation, the driving force of the motor 35 is transmitted to the transporting belt drive shaft 36 via the driven pulley 35*a*, the drive belt 37 and the driven pulley 36*a*, thereby to drive the transporting belts 30*a*, 30*b* and simultaneously transmitted to the pulley 10 via the intermediate pulley 36*b* and the transmission belt 38.

Although the electromagnetic clutch 11 is off and the pulley 10 and the take-out roller shaft 9 are not connected, since the torque limiter 42 consisting of the leaf spring 40 and the friction plate 41 is provided, the rotating force of the pulley 10 is transmitted to the take-out roller shaft 9 via the torque limiter 42 so that torque is lowered by, the torque limiter 42. Since the electromagnetic brake 12 is off and not actuated at this time and the take-out roller shaft 9 is rotatable, the take-out roller shaft 9 begins to rotate with torque lowered by the torque limiter 42. Therefore, the feed roller shaft 25 connected with the take-out roller shaft 9 via the timing belt 7 begins to rotate in synchronism with the rotation of the take-out roller shaft 9 and the take-out rollers 4 and feed rollers 3 begins to synchronously rotate, whereby sheets stacked in the sheet storing means 2 begins to be taken out.

More specifically, since the feed rollers 3 are arranged in such a manner that a part thereof projects from the opening (not shown) of the bottom plate 2*a* of the sheet storing means 2 and the take-out rollers 4 are arranged so as to be adapted for abutting against the end portion of the lower face of the lowermost sheet 1 of the sheets 1 stacked in the sheet storing means 2, when the friction portions 3*a* of the feed rollers 3 come into abutment against the lower face of the lowermost sheet 1 in accordance with the rotation the feed rollers 3, frictional force is produced between the lower face of the lowermost sheet 1 and the friction portions 3*a* of the feed rollers 3 and when the friction portions 4*a* of the take-out rollers 3 come into abutment against the end portion of the lower face of the lowermost sheet 1 in accordance with the rotation of the take-out rollers 3, frictional force is produced between the lower face of the lowermost sheet 1 and the friction portions 4*a* of the take-out rollers 4. The lowermost sheet 1 is taken out through the opening 2*c* of the sheet storing means 2 by the thus produced frictional force and fed to the gap between the take-out rollers 4 and the separation rollers 5 of the friction separating member 6. Since the torque transmitted to the take-out roller shaft 9 and the feed roller shaft 25 is lowered by the torque limiter 42, the sheet 1 is taken out at low speed.

At this time, the driven rollers 19 disposed upstream of the gap between the take-out rollers 4 and the separation rollers 5 and abutting against the periphery of the take-out rollers 4 rotate together with the take-out rollers 4, thereby to promote the take-out operation of sheets 1 toward the gap between the take-out rollers 4 and the separation rollers 5 of the friction separating member 6.

Thus, when the leading edge of the sheet 1 taken out from the sheet storing means 2 reaches the gap between the take-out rollers 4 and the separation rollers 5 of the friction separating member 6, in the case where the pulley 10 and the take-out roller shaft 9 are disconnected by the electromagnetic clutch 11, since, as described above, the magnitude of torque which can be transmitted from the pulley 10 to the take-out roller shaft 9 is determined by the torque limiter 42 so that in accordance with the rotation of the feed rollers 3 and the take-out rollers 4, frictional force acts on the lower face of the sheet 1 from the feed rollers 3 and take-out rollers 4 lower than the minimum frictional force which acts on the lower face of the sheet 1 and can separate two or more sheets 1 one by one in cooperation with the frictional force applied to the upper face of the sheets 1 from the separation rollers 5, the rotation of the take-out rollers 4 is stopped and the sheets 1 are held at the gap between the take-out rollers 4 and the separation rollers 5 of the friction separating member 6 so that the leading edges thereof abuts against the take-out rollers 4 and the separation rollers 5 of the friction separating member 6.

Afterwards, when the timer means 53 judges that a predetermined time $T_1$ has passed, the timer means 53 outputs a timing signal to the control means 52. The time $T_1$ is a time period capable of ensuring that the rotation speed R of the motor 35 has become a constant speed $R_0$ since the motor 35 was started to rotate, is experimentally determined in advance and stored in the timer means 53. When the timing signal is input from the timer means 53 to the control means 52, the control means 52 outputs an actuation signal to the electromagnetic clutch 11 to turn it on. As a result, the pulley 10 and the take-out roller shaft 9 are connected so that the take-out roller shaft 9 rotates together with the pulley 10 and that the take-out rollers 4 and the feed rollers 3 are rotated with torque corresponding to the driving force of the motor 35. Therefore, since in accordance with the rotation of the take-out rollers 4, great frictional force acts on the lower face of the sheet 1 which has been held at the gap between the take-out rollers 4 and the separation rollers 5 so that the leading edge thereof abuts against the take-out rollers 4 and the separation rollers 5 and, on the other hand, great frictional force the direction of which is opposite to that of the frictional force applied to the lower face of the sheet 1 from the take-out rollers 4 acts on the upper face of the sheet 1 from the separation rollers 5 held stationary, the sheets 1 are separated one by one by the take-out rollers 4 and the friction separating member 6. The sheet 1 passes through the gap between the take-out rollers 4 and the separation rollers 5 and is further transported downwardly in the sheet handling machine, while it is being held between transporting belts 30*a*, 30*b* so that the sheets 1 are stacked in the sheet stacking section (not shown).

According to this embodiment, in the transitional state where the rotation speed R of the motor 35 has not become constant speed $R_0$, since the pulley 10 and the takeout roller shaft 9 are disconnected by the electromagnetic clutch 11, torque of the pulley 10 rotated by the motor 35 is transmitted to the take-out roller shaft 9 only via the torque limiter 42 consisting of the leaf spring 40 and the friction plate 41 and the magnitude of torque which can be transmitted from the pulley 10 to the take-out roller shaft 9 is determined by the torque limiter 42 so that in accordance with the rotation of the feed rollers 3 and the takeout rollers 4, frictional force acts on the lower face of the sheet 1 from the feed rollers 3 and take-out rollers 4 lower than the minimum frictional force which acts on the lower face of the sheet 1 and can separate two or more sheets 1 one by one in cooperation with the frictional force applied to the upper face of the sheets 1 from the separation rollers 5. Therefore, the sheets 1 are gradually fed at low speed from the sheet storing means 2 through the opening 2*c* to the gap between the take-out rollers 4 and the friction separating member 6 consisting of the separation rollers 5 and stopped in the state where the leading edges thereof abut against the take-out rollers 4 and the separation rollers 5. As a result, since it is prevented that the feed rollers 3 and the take-out rollers 4 suddenly begins to rotate with great torque and great frictional force instantaneously acts on the lower face of the sheet 1, whereby sheets 1 are fed at high speed to the gap between the takeout rollers 4 and the friction separating member 6 consisting of the friction rollers 5, even if sheets 1 are not set in the sheet storing means 2 in a desired manner, it is reliably prevented that two or more sheets 1 are engaged with the gap between the take-out rollers 4 and the friction separating member 6 and the leading edges of thereof are damaged or sheet jamming occurs, whereby sheets 1 cannot pass through the gap between the take-out rollers 4 and the friction separating member 6 and cannot be fed to the transporting belts 30*a*, 30*b* until the take-out rollers 4 has been rotated several times, or the take-out rollers 4 are stopped and sheets 1 cannot be fed at all. Further, since the sheets 1 are gradually taken out from the sheet storing means 2 at low speed, the lowermost sheet 1 is easily separated from the sheets 1 placed thereon and it is possible to smoothly start the sheet separation and take-out operation by use of the take-out rollers 4 and the friction separating member 6 after the rotation speed R of the motor 35 has become the constant speed $R_0$.

Figure 7:
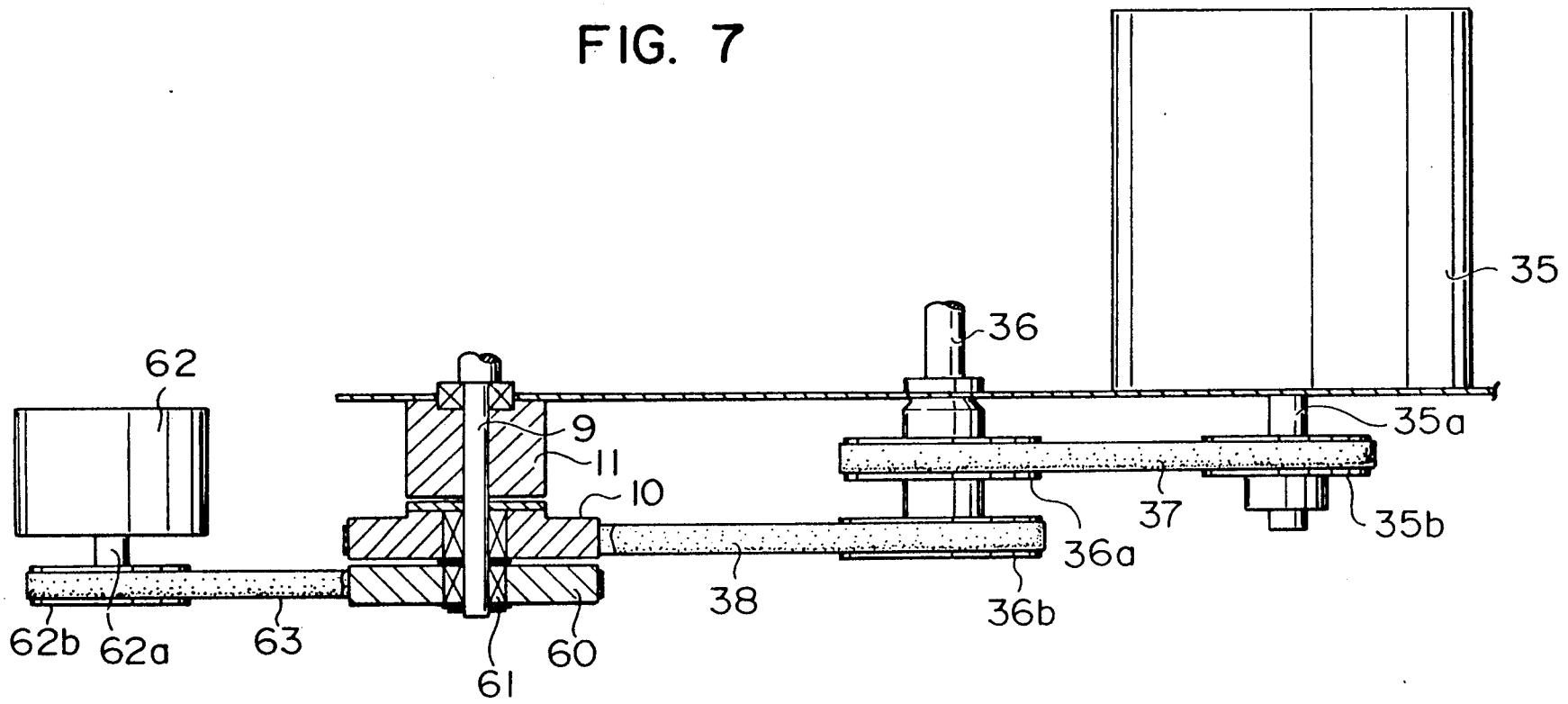
FIG. 7 is a schematic drawing showing a partial plan view of a sheet take-out apparatus which is another embodiment of the present invention.

FIG. 7 is a schematic drawing showing a partial plan view of a sheet take-out apparatus which is another embodiment of the present invention.

In the sheet take-out apparatus shown in in FIG. 7, in place of the torque limiter 42 consisting of the leaf spring 40 and the friction plate 41, a preparatory drive pulley 60 is provided so as to be supported at one end of the take-out roller shaft 9 via a one-way clutch 61. A preparatory drive belt 63 is engaged with the preparatory drive pulley 60 and a drive pulley 62*b* fixed to the output shaft 62*a* of a preparatory drive motor 62. The preparatory drive pulley 60 is rotated by the preparatory drive motor 62 until time $T_1$ has passed since the start switch 51 was turned on after the initiating operation had been completed and the rotation speed R of the motor 35 has become the constant speed $R_0$ so that in accordance with the rotation of the feed rollers 3 and the take-out rollers 4, frictional force acts on the lower face of the sheet 1 from the feed rollers 3 and takeout rollers 4 lower than the minimum frictional force which acts on the lower face of the sheets 1 and can separate two or more sheets 1 one by one in cooperation with the frictional force applied to the upper face of the sheets 1 from the separation rollers 5. The one-way clutch 61 is constituted so as to transmit the rotational force of the preparatory drive pulley 60 to the take-out roller shaft 9 only when the preparatory drive pulley 60 rotates so as to transmit the rotational force having the same direction as that of transportation of sheets 1 to the take-out roller shaft 9.

Figure 8:
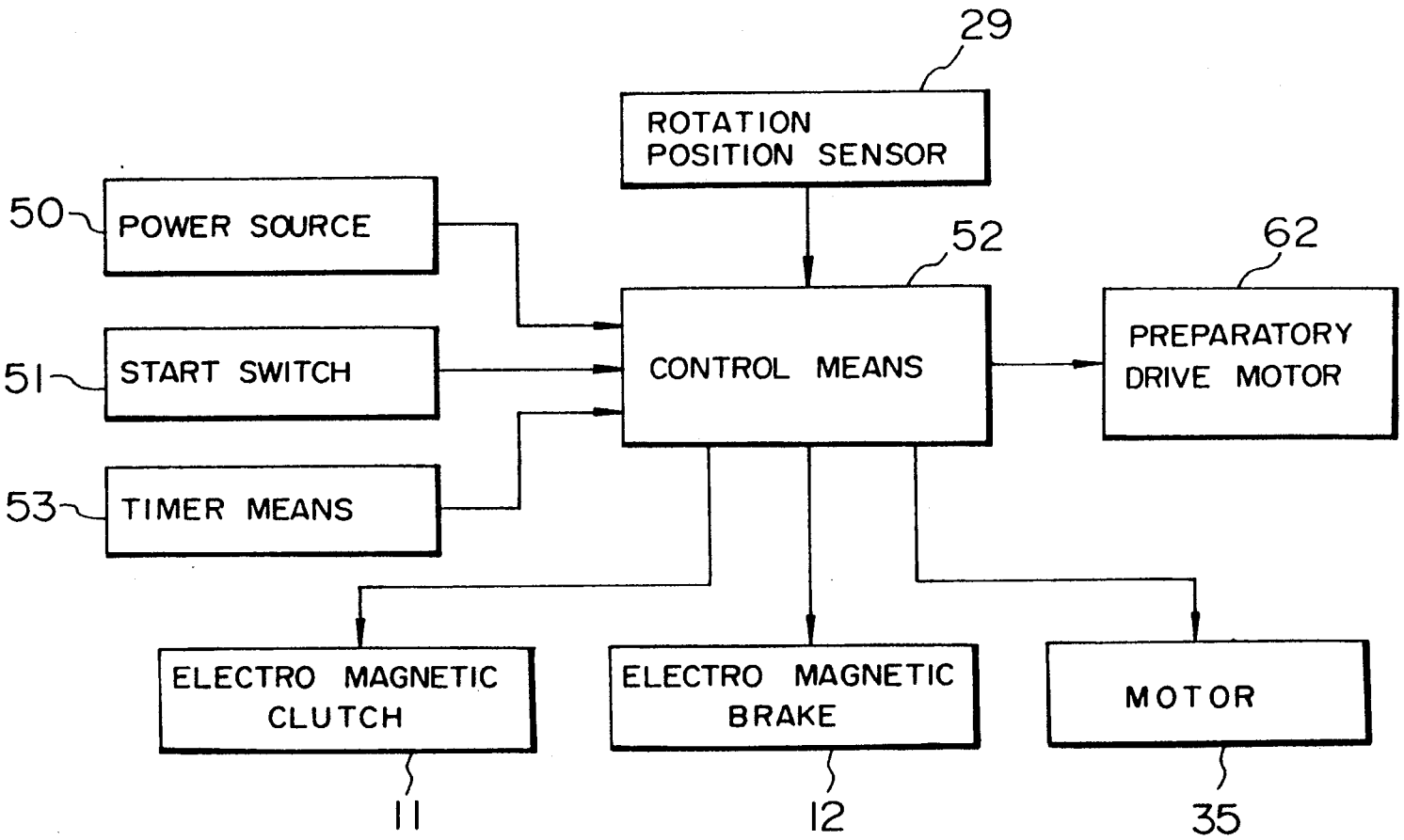
FIG. 8 is a block diagram showing a control system of a sheet take-out apparatus shown in FIG. 7.

FIG. 8 is a block diagram showing a control system of the sheet take-out apparatus of this embodiment.

As shown in FIG. 8, the control system of the sheet take-out apparatus of this embodiment has the same arrangements as those of the embodiment shown in FIG. 4 except that the control means 52 outputs a drive signal to the preparatory drive motor 62 so as to drive it until time $T_1$ has passed since the start signal was input from the start switch 51 and the timing signal is input from the timer means 53.

In the thus constituted sheet take-out apparatus of this embodiment, when the start switch 51 is turned on and the start signal is input to the control means 52, the control means 52 outputs a drive signal to the motor 35 to drive it and outputs a drive signal to the preparatory drive motor 62 to drive it. At the same time, the control means 52 outputs a stop signal to the electromagnetic brake 12, thereby to stop the operation thereof and cause the take-out roller shaft 9 rotatable. At this time, no actuation signal is output to the electromagnetic clutch 11 and the electromagnetic clutch 11 is held off, whereby the pulley 10 and the take-out roller shaft 9 are disconnected. Therefore, the driving force of the motor 35 is not transmitted to the take-out roller 9 and the take-out roller shaft 9 is rotated with low torque by the driving force of the preparatory drive motor 62 transmitted via the drive pulley 62*a*, the drive belt 63, the preparatory drive pulley 60 and the one-way clutch 61, sheets 1 stored in the sheet storing means 2 are fed toward the gap between the take-out rollers 4 and the friction separating member 6 at low speed by the feed rollers 3 and the take-out rollers 4 which are rotated with low torque. Since torque transmitted to the take-out roller shaft 9 via the preparatory drive pulley 60 is determined so that in accordance with the rotation of the feed rollers 3 and the take-out rollers 4, frictional force acts on the lower face of the sheet 1 from the feed rollers 3 and take-out rollers 4 lower than the minimum frictional force which acts on the lower face of the sheet 1 and can separate two or more sheets 1 one by one in cooperation with the frictional force applied to the upper face of the sheets 1 from the separation rollers 5, the sheets 1 are stopped and kept in the state where the leading edges thereof abut against the take-out rollers 4 and the separation rollers 5.

Then, when time $T_1$ has passed and the timing signal is input from the timer means 53 to the control means 52, the control means 52 outputs a drive stop signal to the preparatory drive motor 62 to stop it and outputs an actuation signal to the electromagnetic clutch 11 to actuate it, thereby to connect the pulley 10 and the take-out roller shaft 9. As a result, the drive force of the motor 35 the rotation speed of which has become the constant speed $R_0$ is transmitted from the pulley 10 to the take-out roller shaft 9 and the take-out rollers 4 and the feed rollers 3 are rotated with torque corresponding to the driving force of the motor 35, whereby the sheets 1 which have been held at the gap between the take-out rollers 4 and the friction separating member 6 so that the leading edges thereof abut against the take-out rollers 4 and the separation rollers 5 are separated one by one, pass through the gap between the take-out rollers 4 and the friction separating member 6, are fed to the transporting belts 30*a*, 30*b* disposed downstream in the sheet handling machine and are further fed to the sheet stacking section (not shown). Since the one-way clutch 61 is provided between the preparatory drive pulley 60 and the take-out roller shaft 9, even if the preparatory drive motor 62 is stopped, the rotation of the take-out roller shaft 9 by the motor 35 is not influenced.

Similarly to the above described embodiment, in this embodiment, in the transitional state where the rotation speed R has not become the constant speed $R_0$, since the pulley 10 and the take-out roller shaft 9 are disconnected by the electromagnetic clutch 11 and torque of the pulley 10 rotated by the motor 35 is not transmitted to the take-out roller shaft 9 but only the driving force of the preparatory drive motor 62 is transmitted, the magnitude of torque transmitted from the preparatory drive motor 62 to the take-out roller shaft 9 being determined so that in accordance with the rotation of the feed rollers 3 and the takeout rollers 4, frictional force acts on the lower face of the sheet 1 from the feed rollers 3 and take-out rollers 4 lower than the minimum frictional force which acts on the lower face of the sheet 1 and can separate two or more sheets 1 one by one in cooperation with the frictional force applied to the upper face of the sheets 1 from the separation rollers 5, the sheets 1 are gradually fed at low speed from the sheet storing means 2 through the opening 2*c* to the gap between the take-out rollers 4 and the friction separating member 6 including the separation rollers 5 and stopped in the state where the leading edges thereof abut against the take-out rollers 4 and the separation rollers 5. As a result, since it is prevented that the feed rollers 3 and the take-out rollers 4 suddenly begins to rotate with great torque and great frictional force instantaneously acts on the lower face of the sheet 1, whereby sheets 1 are fed at high speed to the gap between the take-out rollers 4 and the friction separating member 6 consisting of the friction rollers 5, even if sheets 1 are not set in the sheet storing means 2 in a desired manner, it is reliably prevented that two or more sheets 1 are engaged with the gap between the take-out rollers 4 and the friction separating member 6 and the leading edges of thereof are damaged or jamming occurs, whereby sheets 1 cannot pass through the gap between the take-out rollers 4 and the friction separating member 6 and are not fed to the transporting belts 30*a*, 30*b* until the take-out rollers 4 are rotated several times, or the take-out rollers 4 are stopped and sheets 1 cannot be fed. Further, since the sheets 1 are gradually taken-out from the sheet storing means 2 at low speed, the lowermost sheet 1 is easily separated from the sheet 1 placed thereon and it is possible to smoothly start the sheet separation and take-out operation by use of the take-out rollers 4 and the friction separating member 6 after the rotation speed R of the motor 35 becomes the constant speed $R_0$.

Figure 9:
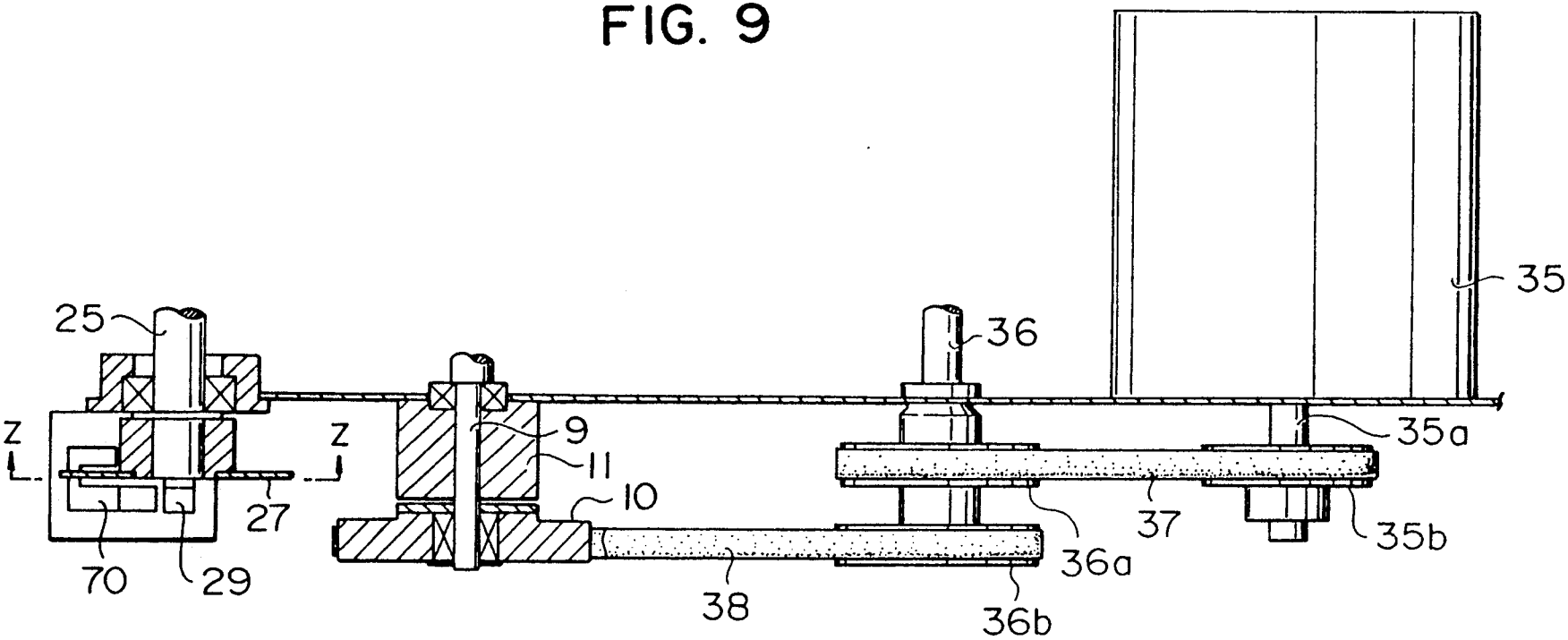
FIG. 9 is a schematic drawing showing a partial plan view of a sheet take-out apparatus which is a further embodiment of the present invention.
Figure 10:
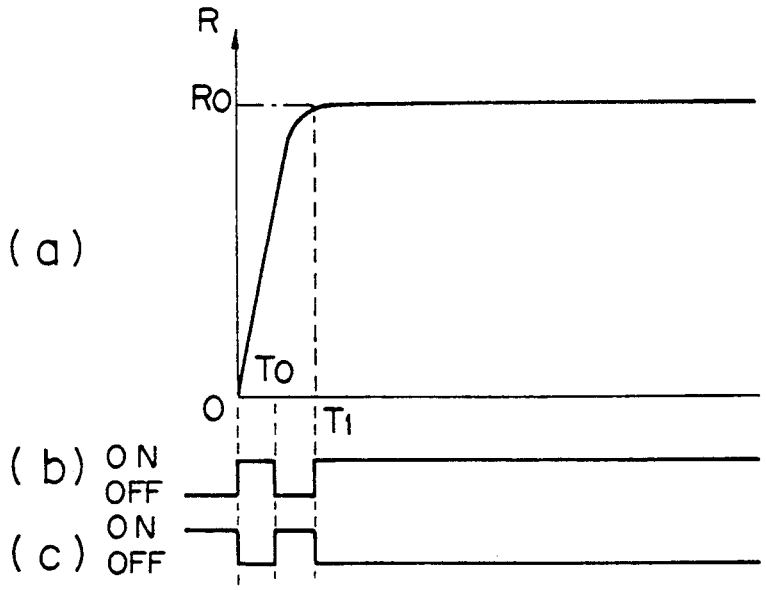
FIGS. 10(*a*), (*b*) and (*c*) is a time chart showing timings of the rotation of a motor, the operation of an electromagnetic clutch and the operation of an electromagnetic brake in a sheet take-out apparatus shown in FIG. 9.

FIG. 9 is a schematic drawing showing a partial plan view of the sheet take-out apparatus which is a further embodiment of the present invention and FIG. 10(*a*), (*b*) and (*c*) is a time chart showing timings of the rotation speed R of the motor 35, "on" and "off" timing of the electromagnetic clutch 11 and "on" and "off" timing of the electromagnetic brake 12.

In the sheet take-out apparatus of this embodiment, without the torque limiter 42 or a preparatory drive mechanism such as the preparatory drive motor 62 and the preparatory drive pulley 60, the driving force of the motor 35 is transmitted to the take-out roller shaft 9 by "on"-"off" control of the electromagnetic clutch 11 and the electromagnetic brake 12 at the timings shown in the time chart of FIG. 10(*a*), (*b*) and (*c*) and the control operation is carried out so that although sheets 1 are fed to the gap between the take-out rollers 4 and the friction separating member 6, the sheet separation and take-out operation is not carried out until the rotation speed R of the motor 35 has become the constant value $R_0$.

More specifically, when the start switch 51 is operated and the start signal is output to the control means 52 and the timer means 53, the control means 52 outputs a drive signal to the motor 35 to drive it and outputs a stop signal to the electromagnetic brake 12, thereby to stop the operation thereof and cause the take-out roller shaft 9 rotatable. Further, the control means 52 outputs an actuation signal to the electromagnetic clutch 11 to turn it on and connect the pulley 10 and the take-out roller shaft 9, thereby to transmit the driving force of the motor 35 to the take-out roller shaft 9 via the pulley 10 and rotate the take-out rollers 4 and the feed rollers 3 at the rotation speed corresponding to the driving force of the motor 35.

Afterwards, when time $T_0$ smaller than the predetermined time $T_1$ has passed, the timer means 53 outputs a first timing signal to the control means 52. When the control means 52 receives the first timing signal, it outputs a stop signal to the electromagnetic clutch 11 to cause it to disconnect the pulley 10 and the take-out roller shaft 9 and outputs an actuation signal to the electromagnetic brake 12 to actuate it, thereby to stop the rotation of the take-out roller shaft 9.

As apparent from the time chart shown in FIG. 10, since the rotation speed R of the motor 35 is small at the initial stage, torque of the take-out rollers 4 and the feed rollers 3 is small and frictional force produced between the sheets 1 and the take-out rollers 4 and the sheets 1 and the feed rollers 3 is correspondingly small. Accordingly, it is possible to control the take-out operation of sheets 1 by selecting the time $T_0$ properly so that until the time $T_0$ has not passed after the take-out operation started, although sheets 1 are gradually taken out at low speed by the feed rollers 3 and the take-out rollers 4 and fed to the gap between the take-out rollers 4 and the friction separating member 6, they cannot pass through the gap between the take-out rollers 4 and the friction separating member 6 and are stopped in the state where the leading edges thereof abut against the take-out rollers 4 and the separation rollers 5 to be kept at that position.

The time $T_0$ is selected in this manner and after the sheets 1 were taken out so as to be held at the gap between the take-out rollers 4 and the friction separating member 6 in the state where the leading edges thereof abut against the take-out rollers 4 and the separation rollers 5, when the time $T_1$ capable of ensuring that the rotating speed R of the motor 35 has become the constant speed $R_0$ has passed, the timer means 53 outputs a second timing signal to the control means 52. When the control means 52 receives the second timing signal, it outputs a stop signal to the electromagnetic brake 12 to stop the operation thereof and outputs an actuation signal to the electromagnetic clutch 11 to connect the pulley 10 and the take-out roller shaft 9, thereby to transmit the driving force of the motor 35 to the take-out roller shaft 9. As a result, the take-out rollers 4 and the feed rollers 3 are rotated with torque corresponding to the rotation of the motor 35 and the sheets 1 held at the gap between the take-out rollers 4 and the friction separating member 6 in the state where the leading edges thereof abut against the take-out rollers 4 and the separation rollers 5 are separated one by one by the take-out rollers 4 and the separation rollers 5 of the friction separating member 6, fed to the transporting rollers 30*a*, 30*b* and stacked in the sheet stacking section (not shown) provided downstream in the sheet handling machine.

In this embodiment, since the take-out rollers 4 and the feed rollers 3 are rotated with low torque at the initial stage of the take-out operation and the sheets 1 are gradually fed to the gap between the take-out rollers 4 and the friction separating member 6 at low speed, it can be effectively prevented that two or more sheets 1 are fed toward the gap between the take-out rollers 4 and the friction separating member 6 at high speed, whereby the leading edges thereof are damaged or they get engaged with the gap between the take-out rollers 4 and the friction separating member 6 and jamming occurs.

Figure 11:
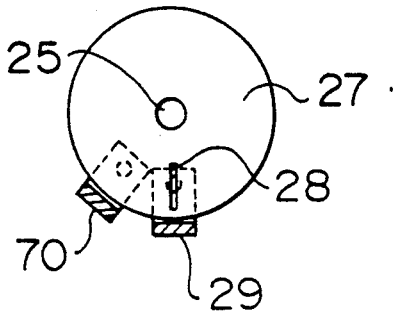
FIG. 11 is a schematic drawing showing a cross sectional view taken on line Z—Z of FIG. 9 which shows a still further embodiment of the present invention.

In the embodiment shown in FIGS. 9 and 10, the first timing signal and the second timing signal are output from the timer means 53 to the control means 52 and after the start signal was input, until the time $T_0$ when the first timing signal is input has passed, the pulley 10 and the take-out roller shaft 9 are connected to transmit the driving force of the motor 35 to the take-out rollers 4 and the feed rollers 3 and rotate the take-out rollers 4 and the feed rollers 3 with low torque produced just after the motor 35 begins to be rotated, whereby the sheets 1 are taken out. Further, after the rotation speed of the motor 35 has become the constant speed, when the second timing signal is output from the timer means 53, the pulley 10 and the take-out roller shaft 9 are connected again, thereby to transmit the driving force of the motor 35 to the take-out rollers 4 and the feed rollers 3 and start the sheet separation and takeout operation. However, in stead of these operation, similarly to the embodiment shown in FIGS. 1 to 7, the timer means 53 may be constituted so as to output only the timing signal which initiates the sheet separation and take-out operation and, as shown in FIG. 11 which is a cross-sectional view taken on line Z—Z of FIG. 9, there may be provided a rotation position sensor 29 disposed in the vicinity of the disc 27 fixed to one end of the feed roller shaft 25 and a second rotation position sensor 70 at an offset position with respect to the rotating direction of the disc 27 so that the second rotation position sensor 70 can detect the slit 28 at the time when the predetermined time $T_0$ has passed after the start switch 51 was turned on and outputs a detection signal to the control means 52 when it detects the slit 28 of the disc 27. According to these arrangements, when the predetermined time $T_0$ has passed after the start switch was turned on, the control means 52 is caused to output a stop signal to the electromagnetic clutch 11, thereby to disconnect the pulley 10 and the take-out roller shaft 9 and output an actuation signal to the electromagnetic brake 12, thereby to actuate it so that the take-out operation of sheets 1 can be carried out similarly to the embodiment shown in FIGS. 9 and 10.

The present invention has thus been shown and described with reference to a specific embodiment. However, it should be noted that the present invention is in no way limited to the details of the described arrangements but changes and modifications may be made without departing from the scope of the appended claims.

For example, in the embodiment shown in FIGS. 1 to 6, although the pulley 10 is supported at one end portion of the take-out roller shaft 9, the electromagnetic clutch 11 capable of connecting the pulley 10 and the take-out roller shaft 9 and the torque limiter 42 consisting of the leaf spring 40 and the friction plate 41, in the embodiment shown in FIGS. 7 and 8, although the preparatory drive pulley 60 is supported at one end portion of the take-out roller shaft 9 via the one-way clutch 61 and further, in the embodiment shown in FIGS. 9, 10 and 11, although the pulley 10 is supported at one end portion of the take-out roller shaft 9 and the electromagnetic clutch 11 capable of connecting the pulley 10 and the take-out roller shaft 9, since the takeout roller shaft 9 and the feed roller shaft 25 are connected by the timing belt 7 so as to synchronously rotate, it is possible to provide the pulley 10 so as to be supported by the feed roller shaft 25, provide the electromagnetic clutch 11 so as to be able to connect the pulley 10 and the feed roller shaft 25 and secure the torque limiter 42 consisting of the leaf spring 40 and the friction plate 41 in the embodiment shown in FIGS. 1 to 6, the preparatory drive pulley 60 may be provided so as to be supported at one end portion of the feed roller shaft 25 via the one-way clutch 61 in the embodiment shown in FIGS. 7 and 8, and further, the pulley 10 may be provided so as to be supported by the feed roller shaft 25 and the electromagnetic clutch 11 may be provided so as to be able to connect the pulley 10 and the feed roller shaft 25 in the embodiment shown in FIGS. 9, 10 and 11.

Further, in any of the above described embodiments, although the electromagnetic brake 12 is provided so that the rotation of the take-out roller shaft 9 can be completely stopped, in the embodiment shown in FIGS. 1 to 6 and that shown in FIGS. 7 and 8, since the take-out rollers 4 are rotated at low speed until the rotation speed of the motor 35 has become the constant speed and the pulley 10 and the take-out roller shaft 9 are connected by the electromagnetic clutch 11, whereby the driving force is transmitted to the take-out roller shaft 9 without being lowered, even if the electromagnetic brake is not provided, there is no problem and, therefore, the electromagnetic brake may be omitted.

Furthermore, in the above described embodiments, although each of the take-out rollers 4 is formed with the groove 4*b* and the positional relationship between the takeout rollers 4 and the separation rollers 5 are adjusted so that a very small part of the separation rollers 5 is positioned in the groove 4*b*, sheets 1 may be separated one by one by the take-out rollers 4 and the separation rollers 5 by determining the clearance between the periphery of each of the take-out rollers 4 and the periphery of one of the separation rollers 5 to be thinner than the thickness of the sheet 1.

Moreover, in the above described embodiment, although the separation rollers 5 are held stationary, the separation rollers 5 may be rotated clockwise in FIG. 2, that is, in the opposite direction to that of the sheet transportation.

Further, if the separation rollers 5 are not rotated, blocks may be used in place of the separation rollers 5.

Furthermore, in the above described embodiment, although the driven rollers 19 are provided for easily taking out the sheets, they may be omitted.

Moreover, in the above described embodiment, although the motor 35 which rotates with constant torque is used, if the sheet take-out apparatus is constituted like the embodiment shown in FIGS. 9 to 11, it is possible to use a motor rpm of which is switchable between low torque and high torque.

Further, it should be noted that each means defined in the appended claims does not necessarily mean a physical means and that cases where the function of individual means can be accomplished by software fall within the scope of the present invention. In addition, the functions of two or more means defined in the appended claims may be accomplished by one physical means and the function of one means defined in the appended claims may be accomplished by two or more physical means in present invention.

We claim:

1. A sheet take-out apparatus comprising sheet storing means for storing a plurality of stacked sheets, take-out roller means disposed at one end of the sheet storing means and at a portion where it can abut against an end portion of a lower face of a lowermost sheet of the sheets stacked in the sheet storing means, having a friction portion on at least a part of an outer periphery thereof and adapted for taking out sheets from said sheet storing means by applying frictional force produced by friction between itself and the lower face of the lowermost sheet by the rotation thereof to the lower face of the lowermost sheet, friction separating means disposed a portion opposite to said take-out roller means and adapted for separating sheets one by one by applying frictional force, the direction of which is opposite to that of the frictional force applied from the take-out roller means to the lowermost sheet, produced by friction between itself and an upper face of the sheets taken out from the sheet storing means to the upper face of the sheets, take-out roller shafts for supporting said take-out roller means, a pulley rotatably supported by said take-out roller shaft, electromagnetic clutch means adapted to connect said pulley and said take-out roller shaft so that said pulley can rotate together with said take-out roller shaft, a motor adapted to rotate said pulley, start means operated by an operator for starting the rotation of said motor and control means adapted for actuating said electromagnetic clutch means so as to connect said pulley and said take-out roller shaft after the rotation speed of the motor has become constant, said sheet take-out apparatus being constituted so that after said start means was operated and the rotation of said motor started, until the rotation speed of said motor has not become constant, said control means controls the rotation of said take-out roller shaft so as to rotate said take-out roller shaft with low torque which produces frictional force applied to the lower face of the lowermost sheet lower than that capable of separating sheets one by one in cooperation with that applied from said friction separating means to the upper face of the sheets.

2. A sheet take-out apparatus in accordance with claim 1 wherein the sheet take-out apparatus further includes feed roller means having a friction portion on at least a part of an outer periphery thereof and disposed below the sheet storing means so as to be able to abut the lower face of the lowermost sheet of the sheets stacked in said sheet storing means, a feed roller shaft for supporting said feed roller means and synchronous drive means adapted to synchronously rotate said feed roller shaft with said take-out roller shaft.

3. A sheet take-out apparatus in accordance with claim 2 wherein the sheet take-out apparatus further includes electromagnetic brake means adapted to stop the rotation of the take-out roller shaft and said control means is adapted to stop the operation of said electromagnetic brake means and hold said take-out roller shaft rotatable until the rotation speed of the motor has become constant after the start means was operated and the rotation of the motor started.

4. A sheet take-out apparatus in accordance with claim 2 wherein the sheet take-out apparatus further includes electromagnetic brake means adapted to stop the rotation of the take-out roller shaft and timer means for counting time elapsed since the start means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated and stop the operation of said electromagnetic clutch means and actuate said electromagnetic brake means when the timing signal is input from said timer means.

5. A sheet take-out apparatus in accordance with claim 2 wherein the sheet take-out apparatus further includes the electromagnetic brake means adapted to stop the rotation of the take-out roller shaft and rotation position detecting means for detecting the rotation position of the take-out roller shaft and outputting a detection signal to said control means after the take-out roller shaft was rotated until a leading edge of at least one sheet has come into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated and stop the operation of said electromagnetic clutch means and actuate said electromagnetic brake means when the detection signal is input from said rotation position detecting means.

6. A sheet take-out apparatus in accordance with claim 1 wherein the sheet take-out apparatus further includes electromagnetic brake means adapted to stop the rotation of the take-out roller shaft and said control means is adapted to stop the operation of said electromagnetic brake means and hold said take-out roller shaft rotatable until the rotation speed of the motor has become constant after the start means was operated and the rotation of the motor started.

7. A sheet take-out apparatus in accordance with claim 1 wherein the sheet take-out apparatus further includes electromagnetic brake means adapted to stop the rotation of the take-out roller shaft and timer means for counting time elapsed since the start means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated, and stop the operation of said electromagnetic clutch means and actuate said electromagnetic brake means when the timing signal is input from said timer means.

8. A sheet take-out apparatus in accordance with claim 1 wherein the sheet take-out apparatus further includes the electromagnetic brake means adapted to stop the rotation of the take-out roller shaft and rotation position detecting means for detecting the rotation position of the take-out roller shaft and outputting a detection signal to said control means after the take-out roller shaft was rotated until a leading edge of at least one sheet has come into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated and stop the operation of said electromagnetic clutch means and actuate said electromagnetic brake means when the detection signal is input from said rotation position detecting means.

9. A sheet take-out apparatus in accordance with claim 1 wherein the sheet take-out apparatus further includes preparatory drive means adapted to rotate said take-out roller means and until the rotation speed of said motor has become constant after said start means was operated and the rotation of said motor started, said control means is adapted to actuate said preparatory drive means so as to rotate said take-out roller shaft with low torque which produces frictional force applied to the lower face of the lowermost sheet lower than that capable of separating sheets one by one in cooperation with that applied from said friction separating means to the upper face of the sheets.

10. A sheet take-out apparatus in accordance with claim 9 wherein said preparatory drive means comprises a torque limiter disposed between one end of said take-out roller shaft and said pulley.

11. A sheet take-out apparatus in accordance with claim 10 wherein said torque limiter comprises a friction plate member rotatable together with said pulley and press means for pressing the friction plate member to one end of said take-out roller shaft.

12. A sheet take-out apparatus in accordance with claim 9 wherein said preparatory drive means comprises a preparatory drive pulley supported by said take-out roller shaft, a preparatory drive motor and a one-way clutch disposed between said preparatory drive pulley and said take-out roller shaft and adapted to transmit only the rotational force of the preparatory drive pulley having the same direction as that of sheet transportation to said take-out roller shaft and said control means is adapted to drive the preparatory drive motor until the rotation speed of the motor has become constant after the start means was operated and the rotation of the motor started.

13. A sheet take-out apparatus in accordance with claim 9 wherein the sheet take-out apparatus further includes feed roller means having a friction portion on at least a part of an outer periphery thereof and disposed below the sheet storing means so as to be able to abut the lower face of the lowermost sheet of the sheets stacked in said sheet storing means, a feed roller shaft for supporting said feed roller means and synchronous drive means adapted to synchronously rotate said feed roller shaft with said take-out roller shaft.

14. A sheet take-out apparatus in accordance with claim 13 wherein the sheet take-out apparatus further includes electromagnetic brake means adapted to stop the rotation of the take-out roller shaft and timer means for counting time elapsed since the start means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated and stop the operation of said electromagnetic clutch means and actuate said electromagnetic brake means when the timing signal is input from said timer means.

15. A sheet take-out apparatus in accordance with claim 13 wherein the sheet take-out apparatus further includes the electromagnetic brake means adapted to stop the rotation of the take-out roller shaft and rotation position detecting means for directing the rotation position of the take-out roller shaft and outputting a detection signal to said control means after the take-out roller shaft was rotated until a leading edge of at least one sheet has come into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated and stop the operation of said electromagnetic clutch means and actuate said electromagnetic brake means when the detection signal in input from said rotation position detecting means.

16. A sheet take-out apparatus in accordance with claim 9 wherein the sheet take-out apparatus further includes electromagnetic brake means adapted to stop the rotation of the take-out roller shaft and said control means is adapted to stop the operation of said electromagnetic brake means and hold said take-out roller shaft rotatable until the rotation speed of the motor has become constant after the start means was operated and the rotation of the motor started.

17. A sheet take-out apparatus in accordance with claim 9 wherein the sheet take-out apparatus further includes electromagnetic brake means adapted to stop the rotation of the take-out roller shaft and timer means for counting time elapsed since the shaft means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated and stop the operation of said electromagnetic clutch means and actuate said electromagnetic brake means when the timing signal is input from said timer means.

18. A sheet take-out apparatus in accordance with claim 9 wherein the sheet take-out apparatus further includes the electromagnetic brake means adapted to stop the rotation of the take-out roller shaft and rotation position detecting means for detecting the rotation position of the take-out roller shaft and outputting a detection signal to said control means after the take-out roller shaft was rotated until a leading edge of at least one sheet has come into abutment against the take-out roller means and said friction separating means and before the rotation speed has become constant and said control means is adapted to actuate said electromagnetic clutch means so as to connect said take-out roller shaft and said pulley and stop the operation of the electromagnetic brake means when the start means is operated and stop the operation of said electromagnetic clutch means and actuate said electromagnetic brake means when the detection signal is input from said rotation position detecting means.

19. A sheet take-out apparatus comprising sheet storing means for storing a plurality of stacked sheets, take-out roller means disposed at one end of the sheet storing means and at a portion where it can abut against an end portion of a lower face of a lowermost sheet of the sheets stacked in the sheet storing means, having a friction portion on at least a part of an outer periphery thereof and adapted for taking out sheets from said sheet storing means by applying frictional force produced by friction between itself and the lower face of the lowermost sheet by the rotation thereof to the lower face of the lowermost sheet, friction separating means disposed at a portion opposite to said take-out roller means and adapted for separating sheets one by one by applying frictional force, the direction of which is opposite to that of the frictional force applied from the takeout roller means to the lowermost sheet, produced by friction between itself and an upper face of the sheets taken out from the sheet storing means to the upper face of the sheets, take-out roller shafts for supporting said take-out roller means, feed roller means having a friction portion on at least a part of an outer periphery thereof and disposed below the sheet storing means so as to be able to abut the lower face of the lowermost sheet of the sheets stacked in said sheet storing means, a feed roller shaft for supporting said feed roller means, synchronous drive means adapted to synchronously rotate said feed roller shaft with said takeout roller shaft, a pulley rotatably supported by said feed roller shaft, electromagnetic clutch means adapted to connect said pulley and said feed roller shaft so that said pulley can rotate together with said feed roller shaft, a motor adapted to rotate said pulley, start means operated by an operator for starting the rotation of said motor and control means adapted for actuating said electromagnetic clutch means so as to connect said pulley and said feed roller shaft after the rotation speed has become constant, said sheet take-out apparatus being constituted so that until the rotation speed of the motor has become constant after said start means was operated and the rotation of said motor started, said control means controls the rotation of said feed roller shaft so as to rotate said feed roller shaft with low torque which produces frictional force applied to the lower face of the lowermost sheet lower than that capable of separating sheets one by one in cooperation with that applied from said friction separating means to the upper face of the sheets.

20. A sheet take-out apparatus in accordance with claim 19 wherein the sheet take-out apparatus further includes preparatory drive means adapted to rotate said feed roller means and after said start means was operated and the rotation of said motor started, until the rotation speed of said motor has not become constant, said control means is adapted to actuate said preparatory drive means so as to rotate said feed roller shaft with low torque which produces frictional force applied to the lower face of the lowermost sheet lower than that capable of separating sheets one by one in cooperation with that applied from said friction separating means to the upper face of the sheets.

21. A sheet take-out apparatus in accordance with claim 20 wherein said preparatory drive means comprises a torque limiter disposed between one end of said feed roller shaft and said pulley.

22. A sheet take-out apparatus in accordance with claim 21 wherein said torque limiter comprises a friction plate member rotatable together with said pulley and press means for pressing the friction plate member in one end of said take-out roller shaft.

23. A sheet take-out apparatus in accordance with claim 20 wherein said preparatory drive means comprises a preparatory drive pulley supported by said feed roller shaft, a preparatory drive motor and a one-way clutch disposed between said preparatory drive pulley and said feed roller shaft and adapted to transmit only the rotational force of the preparatory drive pulley having the same direction as that of sheet transportation to said feed roller shaft and said control means is adapted to drive the preparatory drive motor until the rotation speed of the motor has become constant after the start means has been operated and the rotation of the motor has been started.

24. A sheet take-out apparatus in accordance with claim 20 wherein the sheet take-out apparatus further includes electromagnetic brake means adapted to stop the rotation of the feed roller shaft and said control means is adapted to stop the operation of said electromagnetic brake means and hold said feed roller shaft rotatable until the rotation speed of the motor has become constant after the start means was operated and the rotation of the motor started.

25. A sheet take-out apparatus in accordance with claim 20 wherein the sheet take-out apparatus further includes electromagnetic brake means adapted to stop the rotation of the feed roller shaft and time means for counting time elapsed since the start means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said feed roller shaft and said pulley and stop the operation of the electromagnetic brake means when the start means is operated and stop the operation of said electromagnetic clutch means and actuate said electromagnetic brake means when the timing signal is input from said timer means.

26. A sheet take-out apparatus in accordance with claim 20 wherein the sheet take-out apparatus further includes the electromagnetic brake means adapted to stop the rotation of the feed roller shaft and rotation position detecting means for detecting the rotation position of the feed roller shaft and outputting a detection signal to said control means after the feed roller shaft was rotated until a leading edge of at least one sheet has come into abutment against the take-out roller means and said friction separating means and before the rotation speed has become constant and said control means is adapted to actuate said electromagnetic clutch means so as to connect said feed roller shaft and said pulley and stop the operation of the electromagnetic brake means when the start means is operated and stop the operation of said electromagnetic clutch means and actuate said electromagnetic brake means when the detection signal is input from said rotation position detecting means.

27. A sheet take-out apparatus in accordance with claim 19 wherein the sheet take-out apparatus further includes electromagnetic brake means adapted to stop the rotation of the feed roller shaft and said control means is adapted to stop the operation of said electromagnetic brake means and hold said feed roller shaft rotatable until the rotation speed of the motor has become constant after the start means was operated and the rotation of the motor started.

28. A sheet take-out apparatus in accordance with claim 19 wherein the sheet take-out apparatus further includes electromagnetic brake means adapted to stop the rotation of the feed roller shaft and timer means for counting time elapsed since the start means was operated and outputting a timing signal to said control means after a leading edge of at least one sheet came into abutment against the take-out roller means and said friction separating means and before the rotation speed has become constant and said control means is adapted to actuate said electromagnetic clutch means so as to connect said feed roller shaft sand said pulley and stop the operation of the electromagnetic brake means when the start means is operated and stop the operation of said electromagnetic clutch means and actuate said electromagnetic brake means when the timing signal is input from said timer means.

29. A sheet take-out apparatus in accordance with claim 19 wherein the sheet take-out apparatus further includes the electromagnetic brake means adapted to stop the rotation of the feed roller shaft and rotation position detecting means for detecting the rotation position of the feed roller shaft and outputting a detection signal to said control means after the feed roller shaft was rotated until a leading edge of at lest one sheet has come into abutment against the take-out roller means and said friction separating means and before the rotation speed has become constant and said control means is adapted to actuate said electromagnetic clutch means so as to connect said feed roller shaft and said pulley and stop the operation of the electromagnetic brake means when the start means is operated and stop the operation of said electromagnetic clutch means and actuate said electromagnetic brake means when the detection signal is input from said rotation position detecting means.

* * * * *